United States Patent [19]

Motooka

[11] Patent Number: 4,915,735

[45] Date of Patent: Apr. 10, 1990

[54] WEAR-RESISTANT SINTERED ALLOY AND METHOD FOR ITS PRODUCTION

[75] Inventor: Naoki Motooka, Itami, Japan

[73] Assignee: Sumotomo Electric Industries, Ltd., Osaka, Japan

[21] Appl. No.: 180,819

[22] PCT Filed: Jul. 14, 1987

[86] PCT No.: PCT/JP87/00505

§ 371 Date: May 10, 1988

§ 102(e) Date: May 10, 1988

[87] PCT Pub. No.: WO88/00621

PCT Pub. Date: Jan. 28, 1988

[30] Foreign Application Priority Data

Jul. 14, 1986 [JP] Japan ..... 61-165230
Mar. 6, 1987 [JP] Japan ..... 62-52650

[51] Int. Cl.[4] ..... C22C 29/00

[52] U.S. Cl. ..... 75/231; 75/237; 75/246; 419/16; 419/17; 419/23; 419/38; 419/57

[58] Field of Search ..... 75/230, 231, 237, 236, 75/246, 242; 419/38, 57, 23, 16, 17

[56] References Cited

U.S. PATENT DOCUMENTS

| | | | |
|---|---|---|---|
| 3,297,571 | 1/1967 | Bonis | 252/12 |
| 4,035,159 | 7/1977 | Hashimoto et al. | 75/246 |
| 4,214,905 | 7/1980 | Sliney | 75/200 |
| 4,268,309 | 5/1981 | Serino et al. | 75/230 |

*Primary Examiner*—Stephen J. Lechert, Jr.
*Assistant Examiner*—Ngoclan Mai
*Attorney, Agent, or Firm*—Cushman, Darby & Cushman

[57] ABSTRACT

A wear-resistant sintered alloy comprising an Cr-C-Fe base alloy in which 0.5 to 3% by weight of $CaF_2$ and 5 to 20% by weight of hard particles having particle size of 44 to 150 μm and a mean value of Vickers hardness of 800 to 2000 are dispersed. This wear-resistant sintered alloy is produced by a method comprising the steps of adding 1.2 to 2% by weight of carbon powder, 0.5 to 3% by weight of calcium fluoride powder, and 5 to 20% by weight of hard metal powder having the particle size of 44 to 150 μm and a mean value of Vickers hardness of 800 to 2000, to an Fe-Cr-C base alloy powder containing 10 to 20% by weight of Cr and 0.8 to 1.5% by weight of C, mixing them, molding the resultant mixed powder into a desired shaped, and then sintering the compact in the temperature range of from 1180° to 1260° C. in a non-oxidizing atmosphere. The sintered alloy is useful as a material for parts required to have the heat resistance and wear resistance.

12 Claims, No Drawings

WEAR-RESISTANT SINTERED ALLOY AND METHOD FOR ITS PRODUCTION

TECHNICAL FIELD

This invention relates to a wear-resistant sintered alloy and a method for its production and, more particularly, it relates to a material for parts required to have heat resistance and wear resistance, such as valve seat inserts for internal combustion engines.

BACKGROUND ART

In general, valve seat inserts for internal combustion engines are required to have high wear resistance and high heat resistance. For this reason, sintered alloys have widely been used as a material for the valve seat inserts since there is a wide choice of materials and these sintered alloys make it easy to produce valve seat inserts with excellent performances. Most sintered alloys of this kind contain iron as the main component and have a structure where a hard metal such as an Fe-Mo alloy is dispersed in the pearlite matrix. In these sintered alloys, the strength and the heat resistance are given by the matrix metal, while the wear resistance is given by the dispersed hard alloy. If the sintered alloy is required to have higher characteristics the density of, the sintered alloy is increased by copper infiltration or forging before use.

Recently, as the internal combustion engines are improved in performance, the demand for higher wear resistance and heat resistance of the valve seat inserts has increase. It is, however, dificult with the sintered alloys of the prior art to fill such requirements.

High speed steels are considered to be one material which can meet such requirements. Although the high speed steels have excellent wear resistance and heat resistance, there have some problems in that they have difficulty in machining and are high in the material cost since they require use of expensive elements.

In the Patent Gazette of publication No. 58-39222 or laying open NO. 61-52347, a high Cr sintered alloy having high density increased by liquid sintering and containing Cr carbide dispersed in the matrix is described as a cheap wear-resistant alloy as compared with the high speed steels.

The inventors and other joint inventors proposed, in the specifications of patent applications Ser. Nos. 59-121301 (the Patent Gazette of laying open No. 61-561) and 59-121302 (the Patent Gazette of laying open No. 61-505), valve seat inserts with a double layered construction of which two layers have a composition different from one another. Furthermore, we proposed a valve seat insert infiltrated with copper in the specifications of patent applications Ser. Nos. 58-120457 (the Patent Gazette of laying open No. 60-13062) and 58-124058 (the Patent Gazette of laying open No. 60-13055).

The aforesaid high Cr sintered alloys are excellent in the resistance to pitching wear and the resistance to scratching wear, but their functions are insufficient in terms of the resistance to slipping wear. Thus, they are unsuitable for the parts subjected to not only the pitching wear but also the slipping wear, such as valve seat inserts, because of insufficient wear resistance.

From the investigations on the reason why high Cr sintered alloys with sufficient slipping wear resistance cannot be obtained, it has become clear that the high Cr sintered alloy containing C is generally sintered in the region where a liquid phase and a solid phase coexist and forms hard Cr carbide which is expected to contribute to the improvement of the wear resistance, but the Cr carbide produced in the Fe-Cr-C sintered alloy has small particle size of not more than 20 μm, thus making it impossible to obtain sufficiently high wear resistance. As a method for improving the wear resistance, it is therefore considered to promote the grain growth of the Cr carbide to be produced in the matrix by use of higher sintering temperature or longer sintering time. However, it has also become clear that this means sets limits to the grain growth and results in a decrease in strength of the matrix.

On the other hand, the valve seat inserts with a double layered structure involve complex manufacturing steps, thus making it impossible to avoid producing expensive products.

DISCLOSURE OF INVENTION

It is therefore an object of the present invention to solve the aforesaid problems which the high Cr sintered alloys have, thereby providing a wear-resistant sintered alloy which is excellent in not only the pitching wear resistance but also the slipping wear resistance and, further is easy to manufacture.

The above object of the present invention is achieved by incorporating into a Fe-Cr-C sintered alloy hard alloy particles which is stable even in the temperature range where a liquid phase is produced in the Fe-Cr-C sintered alloy, and, further, does not melt into the matrix, to improve the slipping wear resistance without leading to lowering of high pitching wear resistance and thermal strength which the Fe-Cr-C sintered alloy has.

According to the present invention, there is provided a wear-resistant sintered alloy comprising an iron base alloy matrix consisting essentially of 10 to 20 wt% of Cr, 1.5 to 3.5 weight % of C, and the balance essentially iron, characterized in that 0.5 to 3% by weight of $CaF_2$ and 5 to 20% by weight of hard alloy particles having the particle size of 44 to 150 μm and a mean value of Vickers hardness of 800 to 2000 are dispersed in said iron base alloy matrix.

According to the present invention, there is also provided a wear-resistant sintered alloy comprising an iron base alloy matrix consisting essentially of 10 to 20% by weight of Cr, 1.5 to 3.5% by weight of C, 1 to 5% by weight of at least one element selected from the group consisting of Co and Ni, and the balance essentially iron, characterized in that 0.5 to 3% by weight of $CaF_2$ and 5 to 20% by weight of hard alloy particles having particle size of 44 to 150 μm and a mean value of Vickers hardness of 800 to 2000 are dispersed in said iron base matrix Furthermore, according to the present invention there is provided a wear-resistant sintered alloy comprising an iron base alloy matrix consisting essentially of 10 to 20% by weight of Cr, 1.5 to 3.5% by weight of C, 1 to 5% by weight of at least one element selected from the group consisting of Co and Ni, 1 to 5% by weight of one or two elements selected from the group consisting of Mo, Nb W and V, and the balance essentially iron, characterized in that 0.5 to 3% by weight of $CaF_2$ and 5 to 20% by weight of hard alloy particles having the particle size of 44 to 150 μm and a mean value of Vickers hardness of 800 to 2000 are dispersed in said iron base alloy matrix.

According to the present invention the above wear-resistant sintered alloy can be produce by a method comprising the steps of adding 1.2 to 2% by weight of carbon powder, 0.5 to 3% by weight of calcium fluoride powder, and 5 to 20% by weight of hard alloy powder having the particle size of 44 to 150 μm and a mean value of Vickers hardness of 800 to 2000, to an Fe-Cr-C base alloy powder containing 10 to 20% by weight of Cr and 0.8 to 1.5% by weight of C, mixing them, molding the resultant mixed powder into a desired shape, and then sintering the compact in the temperature range of from 1180° to 1260° C. in a non-oxidizing atmosphere.

In the present invention, the term "Fe-Cr-C base alloy" refers to an iron base alloy consisting essentially of 10 to 20% by weight of Cr, 1.5 to 3.5% by weight of C, and the balance essentially iron; and an alloy further containing, according to demand, 1 to 5% by weight of at least one element selected from the group consisting of Co and Ni, or 1 to 5% by weight of at least one element of the group composed of Co and Ni, and 1 to 5% by weight of one or two elements selected from the group consisting of Mo, Nb, W and V, which are added to the matrix, in addition to the above components.

The above alloying elements, i.e., at least one element selected from the group consisting of Co and Ni, or at least one element selected from the group consisting of Co and Ni and at least one element selected from the group consisting of Mo, Nb, W and V, may be added to the mixture when the wear-resistant sintered alloy is produced. Alternatively, these alloying elements may be incorporated into the iron base alloy consisting essentially of 10 to 20% by weight of Cr, 1.5 to 3.5% by weight of C, and the balance essentially iron, before preparation of the mixed powder for the sintered alloy.

The explanation will be hereinafter made on the reasons why the wear-resistant sintered alloy of the present invention has been limited to the composition falling within the above range and, at the same time, on functions of the respective components.

(1) Fe-Cr-C alloy powder

Cr improves the heat resisting strength of the metal matrix and forms carbide with C to improve the wear resistance. However, if the Cr content is less than 10% by weight, the wear resistance and heat resistance cannot be improved sufficiently. If the added amount of Cr is more than 20% by weight, its effects become saturated, and its addition causes the formation of soft sigma phase of Fr-Cr. For these reasons, the range of the Cr content has been limited to 10 to 20% by weight.

C is an element required not only for strengthening the matrix and forming the Cr carbide, but also for forming a liquid phase composed of three elements, Fe, Cr and C, to increase the density of the sintered alloy by the liquid phase sintering. The amount of C required for the metal matrix is 1.5 to 3.5% by weight. If the content of C is less than 1.5% by weight, it is insufficient for improving the strength and the wear resistance resulting from the formation of Cr carbide. If the added amount of C is more than 3.5%, it causes formation of a considerable amount of Cr carbide with $M_2C$ structure of low hardness, resulting in a low wear resistance. For these reasons, the content of C has been limited to the above range.

It is preferred that a part of the C content, i.e., 0.8 to 1.5% by weight of C, is contained in the iron base alloy powder which is used as a material for the matrix when the wear-resistant sintered alloy is produced. If all the C to be added is used in the form of powder, there is a fear of formation of porosities in the sintered alloy since the segregation of C takes place. Furthermore, if the content of C contained in the Fe-Cr-C alloy is less than 0.8% by weight, there is no effect to prevent carbon from segregation since an amount of C powder to be added becomes increased. If the content of C is more than 1.5% by weight, the hardness of the iron base alloy powder becomes considerably high, resulting in lowering of compressibility of the powder. Thus, the content of C in the iron base alloy has been limited to 0.8 to 1.5% by weight. The remaining amount of C is added to the mixture for the sintered alloy in the form of C powder so that the total amount in the sintered alloy is 1.5 to 3.5% by weight.

(2) $CaF_2$ (calcium fluoride)

$CaF_2$ with a self-lubricating property considerably contributes to improvement in the wear resistance and has an effect on the improvement of machining properties. If the added amount of $CaF_2$ is less than 0.5% by weight, its addition has little effect. If the added amount of $CaF_2$ is more than 3% by weight, the strength becomes lowered. For these reasons, the range of the $CaF_2$ content has been limited to 0.5 to 3.0% by weight. It is preferred that $CaF_2$ has particle size of less than 149 μm for the following reasons. If the particle size of $CaF_2$ is above 149 μm, its addition contributes to improvement in the wear resistance, but the strength, especially the resistance to thermal shocks, is considerably lowered.

Co and Ni both form a solid solution with the matrix and contribute to improvement in the resistance to thermal shock and in the toughness. Thus, these elements are added to the matrix when the sintered alloy is to be used as a material for valve seat inserts especially required to have the resistance to thermal shocks. Co and Ni may be added to the matrix singly or in combination. If the added amount of Co and/or Ni is less than 1% by weight, sufficient effects cannot be obtained. If the added amount of these elements is more than 5% by weight, further improvements cannot be obtained since the saturation of the effects takes place. Thus, the added amount of these elements has been limited to 1 to 5% by weight from an economical point of view.

All the elements, Mo, Nb, W and V respectively form fine carbides and have an effect on the improvement in the hardness and strength at elevated temperatures. The alloying element to be selected from the group consisting of Mo, Nb, W and V may be used singly or in combination with one or more elements. If the added amount of these elements is less than 1% by weight, the effect of its addition is small. If the added amount of these elements is more than 5% by weight, it causes a decrease in the machining properties and toughness. For these reasons, the content of these alloying elements has been limited to 1 to 5% by weight.

(3) Hard alloy particles

The hard alloy particles are incorporated into the matrix to improve the slipping wear resistance. However, if its Vickers hardness (mean value) is less than 800, it has little effect on the improvement in the slipping wear resistance. If the Vickers hardness is more than 2000, the hard particles insure the mold when the powder is compacted, resulting in a considerable increase in the abrasion of the mold. For these reasons, the Vickers hardness of the hard alloy particles has been limited to 800 to 2000. It is to be noted that the Vickers hardness of the hard alloy particle cannot be unqualifiedly determined since the wear resistance of the valve seat inserts is to be determined according to an opposing member with which the valve seat insert is in contact. However, if the opposing member is of a soft material, it is preferred to use hard alloy particles having the Vickers hardness of not more than 1500. If the opposing member is of a hard material, it is preferred to use hard alloy particles having the Vickers hardness of 1500 to 2000. In some cases, the above hard alloy particles may have a multi-phase internal structure. In such a case, the Vickers hardnes means a mean value of the Vickers hardness of the interior of the particles.

Further, the hard alloy particles to be used are those having such particle size that they pass through a 100 mesh screen defined under ASTM, but cannot pass through a 325 mesh screen and, more definitely, those having particle size of 44 to 150 μm. If the particle size is less than 44 μm, they have a small effect on the improvement in the slipping wear resistance. If the hard alloy particle has particle size of more than 150 μm, the addition thereof causes lowering in the molding characteristics and compressibility of the mixed powder of raw materials, and results in lowering in the strength and machining properties of the sintered alloy. Also, it is preferred to use the hard alloy particles with a mean particle size ranging from 70 to 120 μm for the following reasons. If the mean particle size is less than 70 μm, favorable results can not be obtained. If the mean particle size is more than 120 μm, it causes lowering of the molding characteristics and compressibility of the mixed powder of the raw materials and, at the same time, lowering in the strength and machining properties of the sintered alloy.

The above hard alloy particles are added to the matrix in the form of a hard alloy powder when the sintered alloy is produced. The most important properties required for the hard alloy powder are that they are stable in the temperature range of 1180° to 1260° C. and that they don't melt into the matrix.

As the hard alloy powder which satisfies such requirements, a powder of a Fe-Cr-C hard alloy is prefered consisting essentially of 50 to 70% by weight of Cr, 5 to 10% by weight of C, not more than 1% by weight of Si, and the balance essentially Fe. The hard alloy of the above range has a single structure and possesses the Vickers hardness of 800 to 2000. This hard alloy contributes to the improvement in the slipping wear resistance and is stable even at sintering temperatures of the above range.

It is preferred that the wear-resistant sintered alloy according to the present invention has such a density that its density ratio is not less than 95%. If the density ratio is less than 95%, it causes lowering in the strength and pitching wear resistance because of increase of the porosity.

Furthermore, when producing the above wear resistance sintered alloy, the alloy should be sintered preferably at a temperature ranging from 1180° to 1260° C. for the following reasons. If the sintering temperature is less than 1180° C., high strength cannot be obtained because of insufficient sintering. If the sintering temperature is above 1260° C., it causes formation of a considerable amount of liquid phase, which makes it impossible to retain the shape of the compact. In addition, the sintering atmosphere is required to be a non-oxidizing atmosphere since a large amount of Cr is contained as one component for the sintered alloy.

The invention will be further explained with reference to examples thereof.

EXAMPLE 1

As a raw material powder for the matrix, there were prepared powders of alloys each having a composition shown in Table 1. All the alloy powders were prepared by atomization. Added to each alloy powder were $CaF_2$ powder, graphite powder, and alloy metal powder in the predetermined ratios to prepare a sintered alloy having a composition as shown in Table 2.

Additionally added to the resultant mixture was 0.8% by weight of zinc stearate as a lubricating material out of the composition. The resultant mixed powder was compression molded into rings and square bars under a pressure of 7 t/cm$^2$ and then sintered at a temperature of 1200° to 1250° C. for 60 minutes in a non-oxidizing atmosphere.

The powders of $CaF_2$ and alloy metal used in the example have the mean particle size of not more than 149 μm. For comparison, there were prepared sintered bodies using powders of $CaF_2$ and hard alloys with the mean particle size of more than 149 μm under the same conditions. The compositions of the resultant sintered alloys are also shown Table 2.

TABLE 1

| | Composition of alloy powder (wt %) |
|---|---|
| A | Fe-17% Cr-1% C |
| B | Fe-13% Cr-1% C |
| C | Fe-13% Cr-1% Co-1% C |
| D | Fe-13% Cr-2% Ni-1% C |
| E | Fe-13% Cr-2% Co-1% Mo-1% Nb-1% C |
| F | Fe-13% Cr-1% CO-1% Ni-1% W-1% V-1% C |

TABLE 2

| | | Composition of Matrix Alloy (wt %) | | | | | | | | | | Hard Alloy | |
|---|---|---|---|---|---|---|---|---|---|---|---|---|---|
| | | Cr | C | $CaF_2$ | Co | Ni | Mo | Nb | V | W | Fe | (wt %) | |
| Invention | A | 16 | 2.5 | 2 | — | — | — | — | — | — | balance | 5 | |
| | B | 13 | 2.5 | 2 | — | — | — | — | — | — | " | 10 | |
| | C | 13 | 2.5 | 1 | 1 | — | — | — | — | — | " | 5 | |
| | D | 16 | 2.5 | 1 | — | 2 | — | — | — | — | " | 15 | |
| | E | 13 | 2.5 | 1 | 2 | — | 1 | 1 | — | — | " | 15 | |
| | F | 13 | 2.5 | 1 | 1 | 1 | — | — | 1 | 1 | " | 10 | |
| Comparative material | G | 16 | 2.5 | 2 | — | — | — | — | — | — | " | — | |
| | H | 13 | 2.5 | — | — | — | — | — | — | — | " | 10 | |
| | I | 13 | 2.5 | 2 | — | — | — | — | — | — | " | 10 | $CaF_2$ 150–250 μM |

In order to evaluate the strength of the resultant sintered alloys, the sintered bodies of the ring were subjected to measurement of the radial crushing strength. The measurements were made under two conditions, i.e., at room temperature and 500° C. to determine the heat resisting strength.

On the other hand, using the sintered bodies of the square bar, the specific wear depth was measured by the Ohgoshi abrasion test under the following conditions to determine the abrasive resisting properties. The results are shown in Table 3.

| Abrasion test conditions of Ohgoshi process | |
|---|---|
| Opposing plate: | Heat treated material of S45C (Hardness: HRC49) |
| Relative velocity: | 3.81 m/sec |
| Running distance: | 200 m |
| End load: | 3.2 kg |

TABLE 3

| | | Radial Crushing strength (kgf/mm²) | | Specific wear depth |
|---|---|---|---|---|
| | | Room temp. | 500° C. | (× $10^{-8}$ mm²/kg) |
| Invention | A | 110–112 | 90–103 | 7–10 |
| | B | 93–101 | 88–98 | 3–8 |
| | C | 110–130 | 107–128 | 6–10 |
| | D | 107–122 | 105–119 | 1–6 |
| | E | 108–127 | 107–129 | 2–5 |
| | F | 110–127 | 109–125 | 3–9 |
| Comparative material | G | 130–145 | 132–146 | 58–85 |
| | H | 106–115 | 103–114 | 18–35 |
| | I | 78–85 | 70–83 | 3–5 |

From the results shown in Table 3, the sintered alloys according to the present invention have high mechanical strength and are excellent in the wear resistance.

The specimen G tested as the comparative material contains no hard metals. Thus, this material is high in the strength but poor in the wear resistance. For the specimen H containing no $CaF_2$, it has high strength like specimen G, but it is low in the abrasion resistance. The specimen I is the one prepared by the use of $CaF_2$ having the particle size of 150 and 250 μm beyond the scope of the present invention. This material has good wear resistance but its strength is low.

EXAMPLE 2

A raw material powders, there were prepared Fe-17%Cr-1%C alloy powder, calcium fluoride powder, carbon powder and Fe-Cr-C hard alloy (Fe-66%Cr-9%C-0.5%Si) powder. The former three were a minus sieve of a 100 mesh screen, while the latter, i.e., Fe-Cr-C hard alloy powder, was a minus sieve of a 100 mesh screen but a plus sieve of a 325 mesh screen (corresponding to the particle size of about 50 to 150 μm). These raw materials were weighed and mixed in the proportions shown in Table 4 to prepare several kinds of mixed powder. For comparison, there was prepared a WC hard metal (Vickers hardness: 2000 to 2500). Each of the resultant mixed powder was added with 0.8% of zinc stearate as a lubricating material for mold in addition to the above raw material powders.

TABLE 4

| | Powder and Mixed Ratio (wt %) | | | | | | |
|---|---|---|---|---|---|---|---|
| Symbol | Fe-13% Cr-1% C alloy powder | Fe-13% Cr-1% C alloy powder | C powder | $CaF_2$ powder | Fe—Cr—C hard alloy | WC Hard alloy | |
| J | 91.5 | | 1.5 | 2.0 | 5.0 | | Invention |
| K | 81.5 | | 1.5 | 2.0 | 15.0 | | |
| L | | 91.5 | 1.5 | 2.0 | 5.0 | | |
| M | | 86.5 | 1.5 | 2.0 | 10.0 | | |
| N | | 91.5 | 1.5 | 2.0 | — | 5.0 | Comparative material |
| O | | 93.5 | 1.5 | — | 5.0 | — | |
| P | | 93.5 | 1.5 | — | — | — | |

The mixed powder shown in Table 4 was molded by a metal mold into rings with a 40 mm outside diameter, 27 mm inside diameter and a 10 mm thickness, and square bars of 40×20×5 (mm) by a metal mold under a pressure of 6.5 t/cm². These compacts were then dewaxed in $N_2$ gas at 600° C. for 30 minutes, and sintered in a vacuum at a temperature of 1200° to 1250° C. for 60 minutes.

Each of the resultant sintered bodies had a density with a density ratio of 95 to 99%.

In order to evaluate the strength of the sintered alloys, the radial crushing strength was measured for the sintered bodies of the ring. The measurements were done under two conditions, i.e., B.T. and 400° C. to determine the heat resisting strength.

On the other hand, using the sintered bodies of the square bar, the specific wear depth was measured by the Ohgoshi abrasion test process to determine the slipping abrasion resisting characteristics. The test conditions were as follows:

| Abrasion test conditions of Ohgoshi process | |
|---|---|
| Opposing plate: | Heat treated material of S45C (Hardness: HRC49) |
| Relative velocity: | 3.81 m/sec |
| Running distance: | 200 m |
| End load: | 3.2 kg |

The results are shown in Table 5.

TABLE 5

| | Radial Crushing strength (kgf/mm²) | | Specific wear depth | |
|---|---|---|---|---|
| Material | R. T. | 500° C. | (× $10^{-8}$ mm²/kg) | |
| J | 135–150 | 130–139 | 2–7 | Material of Invention |
| K | 131–140 | 123–132 | 1–5 | |
| L | 126–139 | 120–127 | 8–10 | |
| M | 125–138 | 121–130 | 3–9 | |
| N | 70–74 | 58–74 | 2–6 | Comparative Material |
| O | 145–152 | 142–146 | 13–30 | |
| I | 138–147 | 145–151 | 60–82 | |

From the results shown in Table 5, it is understood that the sintered alloys of the present invention are high in the strength and excellent in the slipping wear-resistant properties.

The specimen N is the sintered alloy containing a WC hard alloy replaced for the hard metal, of which the wear-resistant property is high, but the strength is considerably lowered. The specimen O is the material containing no $CaF_2$. This specimen is high in the strength, but inferior in the wear-resistant property to the specimens of the present invention. The specimen P is the material in which $CaF_2$ and hard alloy are not contained. This material has high strength, but its wear-resistant property is much lower than the materials of the present invention.

INDUSTRIAL APPLICABILITY

The wear-resistant sintered alloy according to the present invention is improved in the heat resistance as well as the slipping wear resistance by incorporating $CaF_2$ and a Fe-Cr-C hard alloy, so that it is useful as a material for parts of the kind where the heat resistance and wear resistance are required, for example, valve seat inserts for high-powered internal combustion engines.

I claim:

1. A wear-resistant sintered alloy consisting essentially of an iron base alloy matrix, 0.5 to 3% by weight of particles of $CaF_2$, and 5 to 20% by weight of particles of a hard alloy, said CaF2 and said hard alloy being dispersed in said iron base alloy matrix in the form of particles, said iron base alloy matrix consisting essentially, by weight, of 10 to 20% of Cr, 1.5 to 3.5% of C, and the balance being essentially iron, said hard alloy consisting essentially, by weight, of 50 to 70 of Cr, 5 to 10% of C, not more than 1% of Si, and the balance being essentially Fe, the particle of said hard alloy having particle size of 44 to 150 μm and the mean value of Vickers hardness of 800 to 2000.

2. A wear-resistnt sintered alloy claimed in claim 1 wherein particle size of $CaF_2$ containe in the iron base alloy matrix is not more than 149 μm.

3. A wear-resistant sintered alloy claimed in claim 1 wherein said sintered alloy has a density of which a density ratio is not less than 95%.

4. A wear-resistant sintered alloy consisting essentially of an iron base alloy matrix, 0.5 to 3% by weight of particles of $CaF_2$, and 5 to 20% by weight of particles of a hard alloy, said $CaF_2$ and said hard alloy being dispersed in said iron base alloy matrix in the form of particles, said iron base alloy matrix consisting essentially, by weight, of 10 to 20% of Cr, 1.5 to 3.5% of C, 1 to 5% of at least one element selected from the group consisting of Co and Ni, and the balance being essentially of iron, said had alloy consisting essentially, by weight, of 50 to 70% of C, not more than 1% of Si, and the balance being essentially Fe, the particles of said hard alloy having particle size of 44 to 150 μm and a mean value of Vickers hardness of 800 to 2000.

5. A wear-resistant sintered alloy claimed in claim 4 wherein particle size of $CaF_2$ contained in the iron base alloy matrix is not more than 149 μm.

6. A wear-resistant sintered alloy claimed in claim 4 wherein said sintered alloy has a density of which a density ratio is not less than 95%.

7. A wear-resistant sintered alloy consisting essentially of an iron base alloy matrix, 0.5 to 3% by weight of particles of $CaF_2$, and 5 to 20% by weight of particles of a hard alloy, said $CaF_2$ and said hard alloy being dispersed in said iron base alloy matrix in the form of particles, said iron base alloy matrix consisting essentially of 10 to 20% by weight of Cr, 1.5 to 3.5% by weight of C, 1 to 5% by weight of at least one element selected from the group consisting of Mo, Nb, W and V, and the balance essentially iron, said hard alloy consisting essentially, by weight, of 50 to 70% of Cr, 5 to 10% of C, not more than 1% of Si, and the balance being essentially Fe, the particles of said hard alloy having the particle size of 44 to 150 μm and a mean value of Vickers hardness of 800 to 2000.

8. A wear-resistant sintered alloy claimed in claim 7 wherein particle size of $CaF_2$ contained in the iron base alloy matrix is not more than 149 μm.

9. A wear-resistant sintered alloy claimed in claim 7 wherein said sintered alloy has a density of which a density ratio is not less than 95%.

10. A method for producing a wear-resistant sintered alloy containing 0.5 to 3% by weight of particles of $CaF_2$, and 5 to 20% by weight of particles of a hard alloy, which are dispersed in a matrix of an iron base alloy in the form of particles, said hard alloy consisting essentially, by weight, of 50 to 70% of Cr, 5 to 10% of C, not more than 1% of Si, and the balance being essentially Fe, said method comprising the steps of mixing 1.2 to 2% by weight of carbon powder, 0.5 to 3% by weight of calcium fluoride powder, 5 to 20% of hard alloy powder having the particle size of 44 to 150 μm and a mean value of Vickers hardness in the range of 800 to 2000, and powder of an iron base alloy containing at least 10 to 20% by weight of Cr and 1.5 to 3.5% by weight of C, molding the resultant mixture into a desired shape to prepare compact, and then firing the resultant compact in the temperature range of 1180° to 1260° C. in a non-oxidizing atmosphere.

11. A method for producing a wear-resistant sintered alloy claimed in claim 10, characterized in that said hard alloy powder is stable at a temperature within the range of 1180° to 1260° C. and does not melt into the matrix of the sintered alloy.

12. A method for producing a wear-resistant sintered alloy claimed in claim 10 characterized in that said hard alloy contains Cr carbide with particle size of not more than 20 μm, and hard alloy with particle size of 44 to 150 μm, said Cr carbide and hard alloy being uniformly dispersed in the matrix of the hard alloy.

* * * * *